US011638925B2

(12) United States Patent
Ding

(10) Patent No.: US 11,638,925 B2
(45) Date of Patent: May 2, 2023

(54) LOTION PUMP

(71) Applicant: Yaowu Ding, Taixing (CN)

(72) Inventor: Yaowu Ding, Taixing (CN)

( * ) Notice: Subject to any disclaimer, the term of this patent is extended or adjusted under 35 U.S.C. 154(b) by 0 days.

(21) Appl. No.: 17/420,167

(22) PCT Filed: Sep. 29, 2019

(86) PCT No.: PCT/CN2019/108973
§ 371 (c)(1),
(2) Date: Jul. 1, 2021

(87) PCT Pub. No.: WO2020/140513
PCT Pub. Date: Jul. 9, 2020

(65) Prior Publication Data

US 2022/0062931 A1 Mar. 3, 2022

(30) Foreign Application Priority Data

Jan. 3, 2019 (CN) ..... 201910004781.4

(51) Int. Cl.
*B05B 11/00* (2023.01)
*B05B 11/10* (2023.01)
(Continued)

(52) U.S. Cl.
CPC ..... *B05B 11/1023* (2023.01); *B05B 11/1074* (2023.01); *B05B 11/1077* (2023.01); *B65D 47/24* (2013.01); *A47K 5/1205* (2013.01)

(58) Field of Classification Search
CPC ..... B05B 11/3023; B05B 11/3074; B05B 11/3077; B05B 11/3067; B05B 11/306;
(Continued)

(56) References Cited

U.S. PATENT DOCUMENTS 3,452,905 A * 7/1969 Micallef ..... B05B 11/3028 222/207
5,518,147 A * 5/1996 Peterson ..... B05B 11/00442 222/153.07
(Continued)

FOREIGN PATENT DOCUMENTS

CN 102464133 A 5/2012
CN 202591008 U * 12/2012 ..... B05B 11/3002
(Continued)

OTHER PUBLICATIONS

International Search Report and Written Opinion dated Dec. 30, 2019, for corresponding International Application No. PCT/CN2019/108973; consisting of 11-pages.

*Primary Examiner* — Bob Zadeh
(74) *Attorney, Agent, or Firm* — Christopher & Weisberg, P.A.

(57) ABSTRACT

A lotion pump includes a movable portion and a stationary portion. A shifting mechanism is formed on the movable portion and the stationary portion, which shifts the elastic restoring mechanism of the lotion pump between a standby state and a non-standby state as the movable portion rotates or moves up and down. The structure of the lotion pump can prevent the spring from yielding due to compressed for a long time, while can also realize a form of locking at lower position.

20 Claims, 16 Drawing Sheets

(51) Int. Cl.
*B65D 47/24* (2006.01)
*A47K 5/12* (2006.01)

(58) Field of Classification Search
CPC .... B05B 11/3001; B65D 47/24; A47K 5/1205
See application file for complete search history.

(56) References Cited

U.S. PATENT DOCUMENTS

| | | | | |
|---|---|---|---|---|
| 9,539,597 | B2 * | 1/2017 | Ding | B05B 11/3002 |
| 11,203,026 | B2 * | 12/2021 | Ding | B05B 11/3077 |
| 2004/0149777 | A1 * | 8/2004 | Santagiuliana | B05B 11/3008 222/190 |
| 2005/0072807 | A1 * | 4/2005 | Hsiao | B05B 11/0032 222/251 |
| 2015/0136810 | A1 * | 5/2015 | Ding | B05B 11/3073 222/321.9 |
| 2022/0062931 | A1 * | 3/2022 | Ding | B05B 11/3023 |

FOREIGN PATENT DOCUMENTS

| | | | | | |
|---|---|---|---|---|---|
| CN | 202591008 | U | | 12/2012 | |
| CN | 202621361 | U | | 12/2012 | |
| CN | 107264970 | A | * | 10/2017 | B05B 11/3077 |
| CN | 207482522 | U | | 6/2018 | |
| CN | 209306148 | U | | 8/2019 | |
| CN | 209492869 | U | | 10/2019 | |
| JP | 5970231 | B2 | | 8/2016 | |
| KR | 20130041586 | A | | 4/2013 | |
| WO | WO-2013170615 | A1 | * | 11/2013 | B05B 11/3002 |

* cited by examiner

LOTION PUMP

CROSS-REFERENCE TO RELATED APPLICATIONS

This application is a submission under 35 U.S.C. § 371 for U.S. National Stage Patent Application of, and claims priority to, International Application Number PCT/CN2019/108973 entitled LOTION PUMP filed Sep. 29, 2019, which is related to and claims priority to Chinese Application Serial No. 201910004781.4 filed Jan. 3, 2019, the entirety of all of which are incorporated herein by reference.

FIELD OF THE DISCLOSURE

The present invention relates to a lotion pump, and especially relates to an all-plastic lotion pump.

BACKGROUND

Lotion pump is broadly used in daily chemicals such as hand sanitizer, shower gel and the like, for pumping the product out from a container such as a bottle, for use. The lotion pumps sold in the market are mostly provided with metal springs, which can restore the lotion pump after a user have pressed the lotion pump to pump an amount of product out for use, thus ready for the next use.

Recently, as requirement for environment protection becoming higher, it is required to recover lotion pump, for realizing recycling of natural source. In order to facilitate in recovering and reusing the lotion pump, it is proposed in the field of lotion pump manufacture to use plastic spring for replacing metal spring, i.e. an all-plastic pump is proposed. Plastic spring is often in the form of plastic helical spring, plastic arc spring, bellow spring, and the like. However, the present plastic spring has some drawbacks, for example when the plastic spring is compressed for a long time, it will yield, thus the spring force of the plastic spring will deteriorate, or even fail to function as a spring. In order to avoid failure of plastic spring due to being compressed for a long time, one solution is to set an all-plastic pump in the form of locking at upper position, and when the lotion pump is in a non-use state, the plastic spring is in a state free of pressing and is relaxed.

FIG. 29 shows an exemplary lotion pump with a plastic spring. Wherein, the lotion pump 1 has a press head 10, a toothed sleeve 20, a cylinder 30 and a piston rod 40, one end of a spring 50 is connected to the piston rod 40, and the other end thereof is connected to the cylinder 30. When the press head 10 is pressed, the piston rod 40 moves down accordingly, so that the spring 50 is compressed, and when the pressure on the press head 10 is removed, the press head 10 restores by means of the elastic force of the spring 50. The lotion pump 1 shown in FIG. 29 is a lotion pump in the form of locking at upper position, and in the non-use state, for example when the product is transported and is displayed for sale, the press head 10 is in its highest position of the stroke, so that the spring 50 is in the state that has the least compress force, therefore, the spring 50 will not yield, which result in failure of the spring, due to being compressed in the non-use state.

It can be seen that the above mentioned lotion pump is a lotion pump of the type of locking at upper position. For a lotion pump of the type of locking at upper position, sometimes it is hard to meet the requirement of package for E-business. And, the lotion pump of the type of locking at upper position has a larger height in its original and non-used state, thus result in a higher requirement for the height of the product box, good shelf and the like.

So, in the field of lotion pump, there is need in further improving structure of a lotion pump with plastic spring, which can solve the problem of plastic spring deteriorating in term of its spring force, and meanwhile meet the requirement of transporting for E-business.

SUMMARY

The present invention is to overcome the above-mentioned technical problem of the existing lotion pump. The object of the present invention is to provide a lotion pump with improved structure, which can protect a plastic spring of the lotion pump from yielding due to being pressed in non-used state, thus provide the same with longer life time, meanwhile it can realize locking at lower position, thus satisfy requirement of E-business transportation.

The lotion pump of the present invention is mounted on a container for dispensing product in the container, the lotion pump includes a movable portion and a stationary portion, when used, the movable portion can move relative to the container, and the stationary portion remain station relative to the container, wherein the lotion pump further includes:

an elastic restoring mechanism, one end of which contacts or connects to the movable portion and the other end of which is fixed to the stationary portion; and a shifting mechanism provided on the movable portion or the stationary portion, and the shifting mechanism is provided to mate with the elastic restoring mechanism, so that when the movable portion rotates in a first direction and/or moves upwardly, one end of the elastic restoring mechanism moves relative to the movable portion to a first position, so that the elastic restoring mechanism is loaded to be brought into a standby state, and when the movable portion rotates in a second direction opposite to the first direction and/or moves downwardly, one end of the elastic restoring mechanism moves relative to the movable portion to a second position, so that the elastic restoring mechanism is brought into a non-standby state.

In the lotion pump with the above mentioned structure, by means of the provision of the shifting mechanism, movement of the movable parts, such as the press head, can shift a supporting seat between the first position and the second position, so as to select to apply a compress force on the elastic restoring mechanism, or reduce the compress force act on the elastic restoring mechanism, or even disengage from the elastic restoring mechanism. Thus, in the non-used state, the elastic restoring mechanism can be applied with a tiny pressure, or is not pressed. Such a structure is especially advantageous for the elastic spring, and can help in extending its lifetime. And, it can be seen that such a structure of the lotion pump can realize the form of locking at lower position, thus it can meet the requirement of package in E-business transportation.

In a specific form, the shifting mechanism is provided on the movable portion. Wherein, the shifting mechanism further includes a first mating part, and a second mating part is formed on the elastic restoring mechanism, when the movable portion moves relative to the container, the first mating part cooperates with the second mating part, so that one end of the elastic restoring mechanism is moved between the first position and the second position.

Preferably, the elastic restoring mechanism includes a spring and a spring supporting seat, the spring supporting seat is positioned at one end of the spring, and the second mating part is formed on the spring supporting seat.

Further preferably, one of the first mating part and the second mating part is a helical rib, the other one of the first mating part and the second mating part is a helical slot, the helical rib can mate into the helical slot, so that when the movable portion rotates, the helical slot and the helical rib act with each other, so that one end of the elastic restoring mechanism moves between the first position and the second position.

For such a detailed structure, during the process that the press head is rotated and thus turns it from a locked state to a standby state, the interaction between the helical slot and the helical rib can move the supporting seat into the second position at the same time, so that the spring is loaded.

Further, as the movable portion rotates, the helical rib can disengage from the helical slot, and the size and the relative position of the helical rib and the helical slot are set such that as the movable portion rotates, the helical rib disengages from the helical slot prior to alignment of a locking block to a cutout. Thereby, in the second position, a lower end of the rib can abut against the supporting seat, so that it is held in the second position, and it can also prevent the helical slot from undesirably entering again into the helical rib when the press head of the lotion pump is pressed.

In detail, the movable portion can includes a press head, a piston rod and a piston, wherein the piston rod is connected at a lower part of the press head, and the piston is provided on the piston rod, the stationary portion includes a toothed sleeve and a cylinder, wherein the cylinder is connected to the toothed sleeve, and at least the portion of the piston rod provided with the piston extends into inside of the cylinder.

Of course, the movable portion and the stationary portion can also be provided differently from the above mentioned, for example the cylinder is of the movable portion, and the piston rod and the piston are of the stationary portion.

Preferably, a locking block is formed at one of a peripheral surface of the piston rod and a top of the toothed sleeve, and a cutout is formed at the other of the peripheral surface of the piston rod and the top of the toothed sleeve, thus by rotating the piston rod, the locking block aligns with the cutout, thus allowing the press head and the piston rod to move upwardly.

By the provision of the upper/lower locking block and a stop of the supporting seat, rotation direction of the press head and the piston rod can be limited, thus preventing operation by mistake.

Preferably, as the piston rod rotates, the helical rib can disengage from the helical slot, and the size and the relative position of the helical rib and the helical slot are set such that as the piston rod rotates, the helical rib disengages from the helical slot prior to alignment of the locking block to the cutout.

Further preferably, the first mating part includes a guide strip, the second mating part includes a cutout, by means of rotation of the piston rod, the guide strip aligns to the cutout, thus allowing one end of the elastic restoring mechanism to move between the first position and the second position.

Besides, an upper locking block is provided above the guide strip, and/or a lower locking block is provided below the guide strip; and a stop is formed above and/or below the second mating part, and the stop mates with the upper locking block and/or the lower locking, so that the movable portion can only rotate in a preset direction.

In another specific structure, the shifting mechanism includes a first mating part, and a second mating part is formed on the elastic restoring mechanism, wherein the first mating portion is a reversed snap ring, by pulling the movable portion upwardly, the second mating part can move through the reversed snap ring so as to move from a first position to a second position, and is held in the second position by the reversed snap ring.

In a preferred structure, the stationary portion includes a toothed sleeve and a cylinder, wherein the cylinder is connected to the toothed sleeve, and at least a portion provided with the piston of the piston rod extends into inside of the cylinder, wherein one of the one end of the elastic restoring mechanism and the outer wall of the cylinder includes a guide block, and the other of the one end of the elastic restoring mechanism and the outer wall of the cylinder is formed with a trough, the guide block is at least partially received in the trough.

Engagement between the trough and the guide block can guarantee that the supporting seat moves in a longitudinal line.

In another preferred structure, the movable portion includes a press head, a piston rod and a piston, wherein the piston rod is connected at a lower part of the press head, and the piston is provided on the piston rod, wherein a first mating part is formed on a peripheral surface of the piston rod and/or of the piston.

In another preferred structure, the movable portion includes a press head, a piston rod, a piston and a casing, wherein the piston rod is connected at a lower part of the press head, and the piston is provided on the piston rod, wherein the casing is sleeved outside the piston rod and/or the piston, and the first mating part is formed on an outer surface of the casing.

Preferably, the elastic restoring mechanism includes at least one elastic strip.

More preferably, the elastic restoring mechanism further includes: an annular upper spring seat, on which an upper end of the elastic strip is connected; and/or an annular lower spring seat, on which a lower end of the elastic strip is connected.

Wherein, the elastic strip is connected to the upper spring seat and/or the lower spring seat by a pivot, wherein when the elastic restoring mechanism is compressed, the pivot pivots and folds.

Preferably, a first guide slot is formed on one of the inner side of the upper spring seat and the stationary portion, a first guide strip is formed on the other of the inner side of the upper spring seat and the stationary portion, and the first guide slot mates with the first guide strip; and/or a second guide slot is formed on one of the inner side of the lower spring seat and the stationary portion, a second guide strip is formed on the other of the inner side of the lower spring seat and the stationary portion, the second guide slot mates with the second guide strip.

By means of engagement between the guide slot and guide strip, the movement of the elastic restoring mechanism can be guided, thus preventing the spring from deflection when the lotion pump is pressed down.

In a preferred structure, a reversed snap part is provided at a lower portion of the stationary portion, the reversed snap part secures the lower spring seat of the spring.

Further, as seen in an axial direction of the lotion pump, the elastic strip extends around at least a portion of the peripheral surface of the cylinder.

BRIEF DESCRIPTION OF DRAWINGS

In the drawings:

FIGS. 6*a*-6*d* show a supporting seat of the lotion pump of FIG. 1, wherein FIG. 6*a* is a sectional view of the supporting seat, FIG. 6*b* is another sectional view of the supporting seat, FIG. 6*c* is a top view of the supporting seat, and FIG. 6*d* is a perspective view of the supporting seat.

FIGS. 7*a* and 7*b* shows a piston rod of the lotion pump of FIG. 1, wherein FIG. 7*a* is a side view of the piston rod 150, and FIG. 7*b* is a front view of the piston rod.

FIGS. 9*a*-9*f* show the spring of the lotion pump shown in FIG. 1, wherein FIG. 9*a* is a front view of the spring, FIG. 9*b* is a perspective view of the spring, FIG. 9*c* is a top view of the spring, FIG. 9*d* is a bottom view of the spring, FIG. 9*e* shows a schematic diagram in a state that the spring surrounds the cylinder, and FIG. 9*f* shows a sectional view taken along line A-A of FIG. 9*e*.

FIGS. 11*a* and 11*b* show a toothed sleeve of the lotion pump shown in FIG. 1, wherein FIG. 11*a* is a front view of the toothed sleeve, and FIG. 11*b* is a top view of the toothed sleeve.

FIGS. 12*a* and 12*b* show sectional views of a lotion pump of a second embodiment of the present invention, wherein FIG. 12*a* shows the lotion pump in a locked state, FIG. 12*b* shows the lotion pump in a standby state.

FIGS. 13*a*-13*d* show a supporting seat of the lotion pump of FIGS. 12*a* and 12*b*, wherein FIG. 13*a* is a top view of the supporting seat, FIG. 13*b* is a sectional view of the supporting seat, FIG. 13*c* is another sectional view of the supporting seat, and FIG. 13*d* is a perspective view of the supporting seat.

FIGS. 14*a* and 14*b* show a piston rod of the lotion pump of FIGS. 12*a* and 12*b*, wherein FIG. 14*a* is a front view of the piston rod, and FIG. 14*b* is a perspective view of the piston rod.

FIGS. 16*a* and 16*b* show sectional views of a lotion pump of a third embodiment of the present invention, wherein FIG. 16*a* shows the lotion pump in a locked state, FIG. 16*b* shows the lotion pump in a standby state.

FIGS. 19*a* and 19*b* show sectional views of a lotion pump of a fifth embodiment of the present invention, wherein FIG. 19*a* shows the lotion pump in a locked state, and FIG. 19*b* shows the lotion pump in a standby state.

FIGS. 28*a* and 28*b* show sectional views of a lotion pump of a sixth embodiment of the present invention, wherein FIG. 28*a* shows the lotion pump in a locked state, and FIG. 28*b* shows the lotion pump in a standby state.

DETAILED DESCRIPTION OF THE INVENTION

Figure 1:
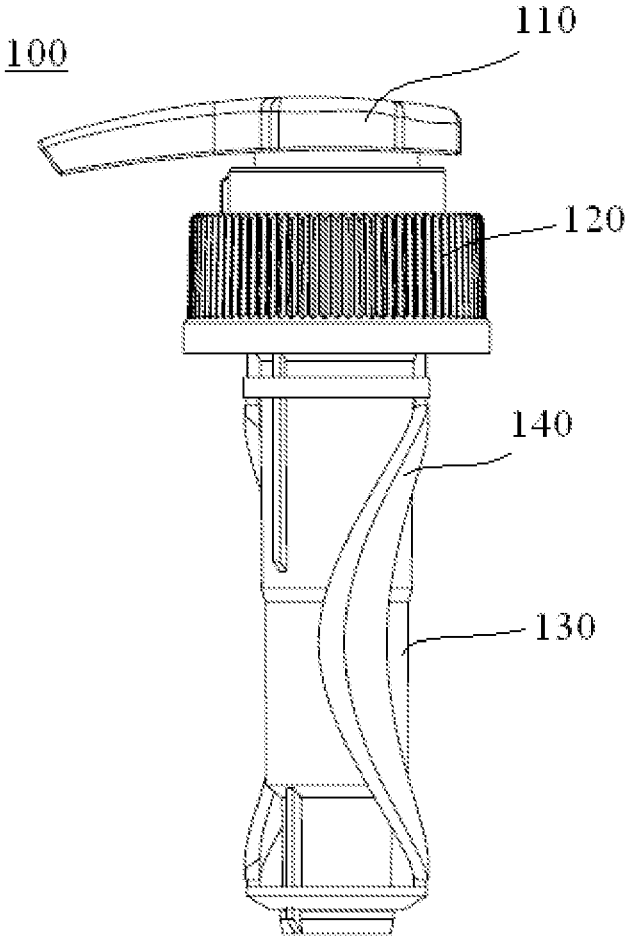
FIG. 1 is a side view of a first embodiment of the lotion pump of the present invention.

A detailed illustration of the embodiments of the present invention will be provided hereinafter with reference to the drawings. It is to be understood that the drawings only show preferred embodiments of the present invention, and it shall not be understood as a limitation of the scope of the present invention. One skilled in the art can make various modification, variation, and replacement with equivalent to the present invention based on the embodiments shown in the drawings, and features in different embodiments stated below can arbitrarily combine with each other as will, unless we expressly state or there is obvious conflicts. All these fall in the protective scope of the present invention.

Embodiment I

Figure 2:
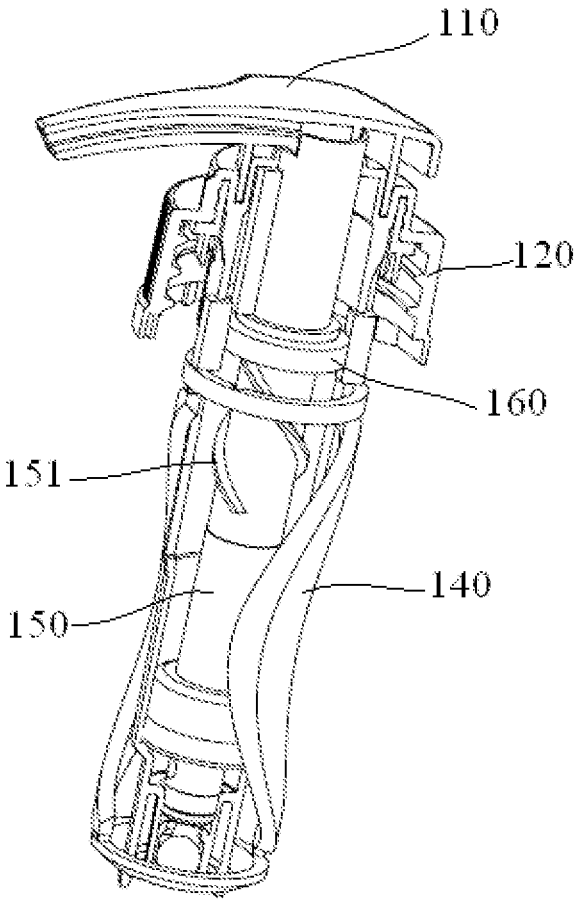
FIG. 2 is a partial cutaway view of the lotion pump of FIG. 1, showing the inside structure of the lotion pump.

FIGS. 1-11*b* shows a lotion pump 100 of a first embodiment of the present invention, with a relaxing mechanism provided in the lotion pump 100. Wherein, FIG. 1 shows a side view of the lotion pump 100, and FIG. 2 shows a partial sectional perspective view of the lotion pump 100, from which an inside structure of the lotion pump can be seen.

The lotion pump 100 includes a press head 110, a toothed sleeve 120 and a cylinder 130. The cylinder 130 connects to the toothed sleeve 120, an elastic restoring mechanism, such as a spring 140, is provided around periphery of the cylinder 130 outside the cylinder 130. Further, as shown in FIG. 2, the lotion pump 100 also includes a piston rod 150 with one end thereof connected to the press head 110 and the other end thereof provided with a piston and extending into inside of the cylinder 130. And, the lotion pump 100 of the present invention further includes a supporting seat 160, the supporting seat 160 is provided inside the cylinder 130 and around the piston rod 150, so that an upper end of the spring 140 is supported on the supporting seat 160, and a lower end of the spring is supported on the cylinder 130, specifically on a lower portion of the cylinder 130.

It can be seen that in the lotion pump 100 of the first embodiment, the press head 110 can move together with the piston rod 150 and the piston on the piston rod 150 relative to the cylinder 130, the toothed sleeve 120 and etc., and the cylinder 130, the toothed sleeve 120 and etc., always remain a fixed or stationary state relative to a container when they are mounted on the container. So, in the lotion pump 100, the press head 110, the piston rod 150 and the piston on the piston rod 150 can be deemed as configuring at least a part of a movable portion of the lotion pump 100, and correspondingly, the cylinder 130 and the toothed sleeve 120 configures at least a part of a stationary portion.

Figure 3:
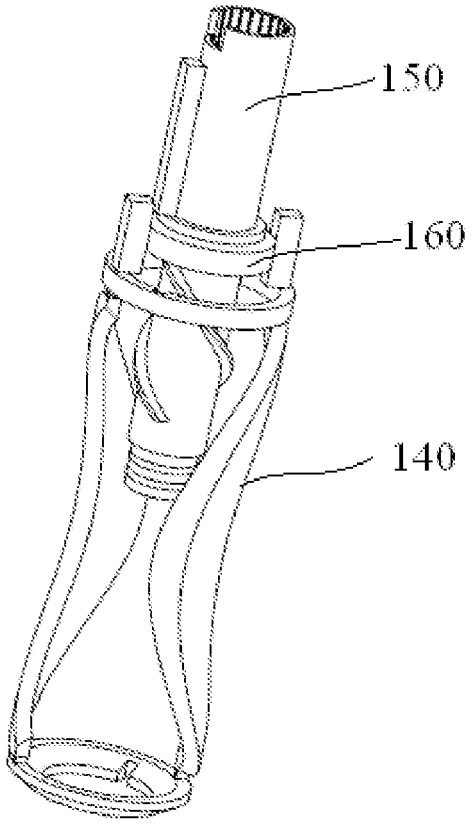
FIG. 3 is a partial perspective view of the lotion pump of FIG. 1, which includes a piston rod, a spring and a supporting seat of the lotion pump.
Figure 4:
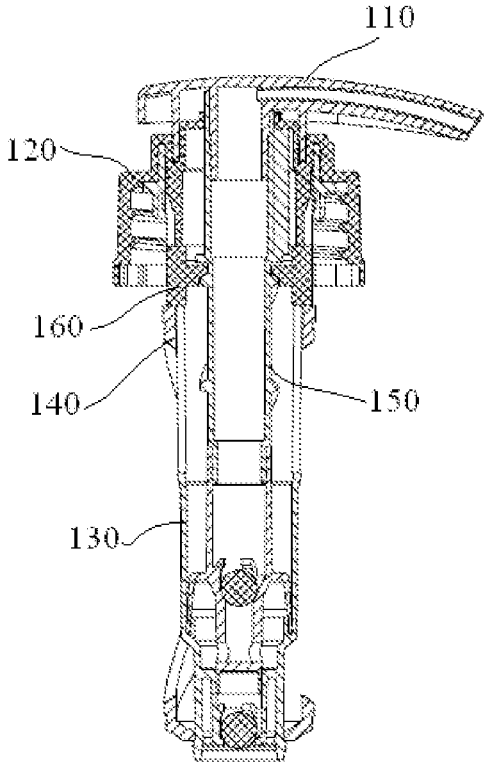
FIG. 4 shows a sectional view of the lotion pump of FIG. 1, wherein the lotion pump is in a locked state.
Figure 5:
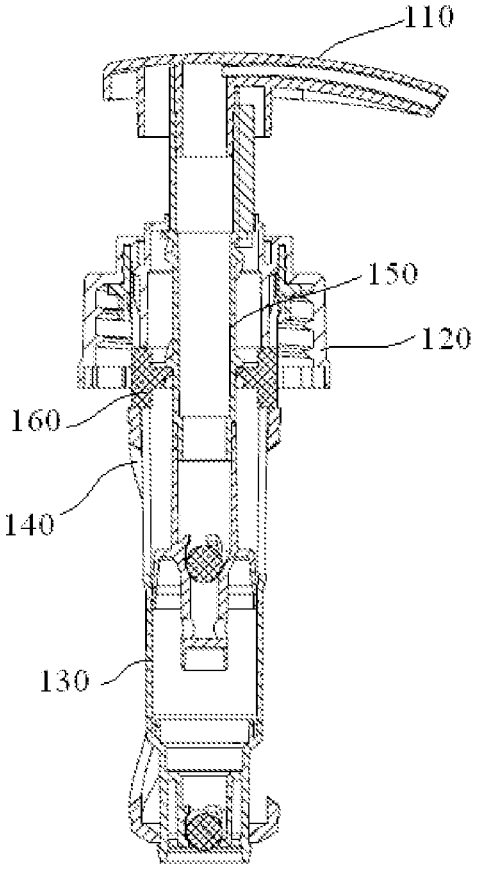
FIG. 5 shows another sectional view of the lotion pump of FIG. 1, wherein the lotion pump is in a standby state.

FIG. 3 shows connection between parts functioning for relaxing of the lotion pump 100 of the present invention. FIGS. 4 and 5 respectively show sectional views of the lotion pump 100 in a non-used state and an open state.

Hereinafter, the detailed structures of the parts of the lotion 100 of the first embodiments will be illustrated, and on such a basis, the interconnection and interaction between the parts will be illustrated with reference to FIGS. 3-5, so as to clearly describe the structure and function principle of the lotion pump 100 of the first embodiment.

Supporting Seat and Piston Rod

In the invention, the piston rod 150 and the supporting seat 160 interact with each other, so that a function of a relaxing mechanism is realized. Specifically as disclosed in the followings.

Figure 6A:
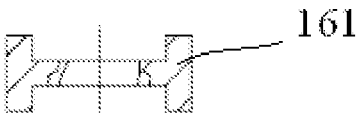
Figure 6B:
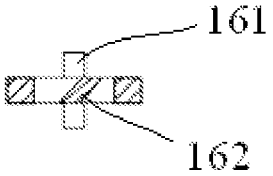
Figure 6C:
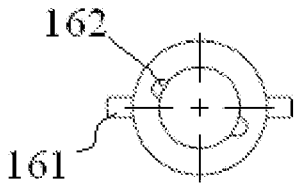
Figure 6D:
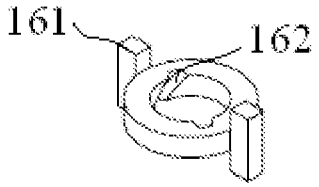

FIGS. 6*a*-6*d* show views of the supporting seat 160 of the lotion pump 100 of the first embodiment, wherein FIGS. 6*a* and 6*b* are sectional views of the supporting seat 160 taken in different directions, FIG. 6*c* is a top view of the supporting seat 160, and FIG. 6*d* is a perspective view of the supporting seat 160.

It can be seen from the drawings that the supporting seat 160 is generally shaped in a ring surrounding and provided outside the piston rod 150, or in other words sleeved outside the piston rod 150 (see FIG. 2). At an outer side of the supporting seat 160, at least one guide block 161, preferably a pair of opposed guide blocks 161, is provided, which cooperates with a trough 131 in the cylinder 130, for limiting movement of the supporting seat 160, which will be described in the detail in the followings.

Figure 7A:
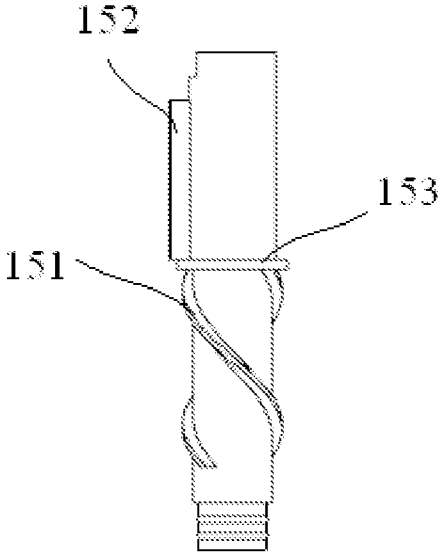
Figure 7B:
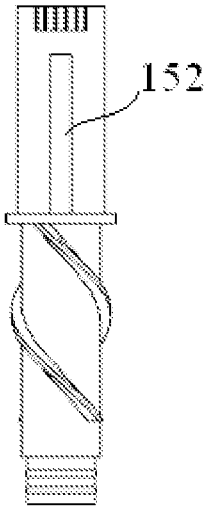

In an inner side of the ring-shaped body of the supporting seat 160, at least one helical slot 162 is provided. In the preferred embodiment shown in FIGS. 6*a*-6*d*, the supporting seat 160 includes two helical slots 162 provided to oppose to each other. Correspondingly, as shown in FIGS. 7*a* and 7*b*, at least one helical rib 151, for example a pair of helical ribs 151 shown in FIGS. 7*a* and 7*b*, which can mate the helical slot 162, is provided on a periphery surface of the piston rod 150. Preferably, a ring-shaped flange 153 is provided above the helical rib 151, when the supporting seat 160 is at its highest position of the stroke, the ring-shaped flange 153 stops the supporting seat 160, preventing the supporting seat 160 from continuing moving upward so that the helical slot 162 disengages from the helical rib 151.

A locking block 152 is further provided on the piston rod 150, mating with a cutout 121 formed on the toothed sleeve 120, particularly on the top of the toothed sleeve 120, allowing the press head 110 to shift between a locked state and a standby state, as described more detailed below.

Figure 8A:
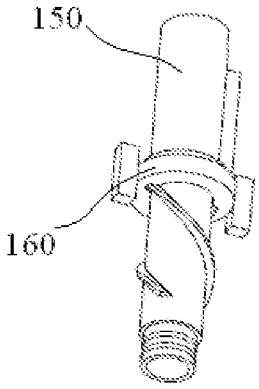
FIGS. 8*a*-8*c* are perspective views showing interaction between the supporting seat and the piston rod, wherein in FIG. 8*a*, the supporting seat is in a first position relative to the piston rod, in FIG. 8*b*, the supporting seat moves relative to the piston rod towards a second position, and in FIG. 8*c*, the supporting seat reaches the second position.
Figure 8B:
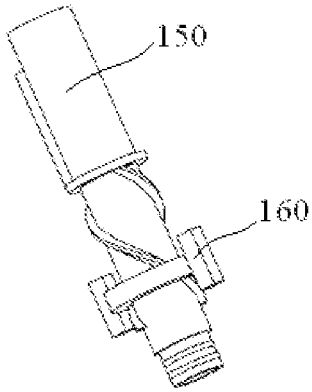
Figure 8C:
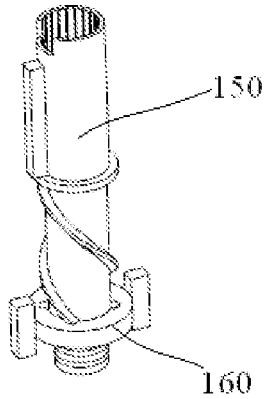

FIGS. 8*a*-8*c* a perspective view shows schematically mating between the piston rod 150 and the supporting seat 160. Specifically, when the press head 110 is rotated and then in turn rotates the piston rod 150 connected thereto, by means of interaction between the helical slot 162 and the helical rib 151, the supporting seat 160 can move downwardly relative to the piston rod 150, as shown in FIG. 8*b*. And, further rotation of the piston rod 150 can disengage the helical rib 151 of the piston rod 150 from the helical slot 162 of the supporting seat 160, and bring a lower end surface of the helical rib 151 into abutment against an upper surface of the supporting seat 160, as the state shown in FIG. 8*c*. Thus, the spring 140 can be brought from a non-standby state into a compressed standby state.

Spring

Figure 9A:
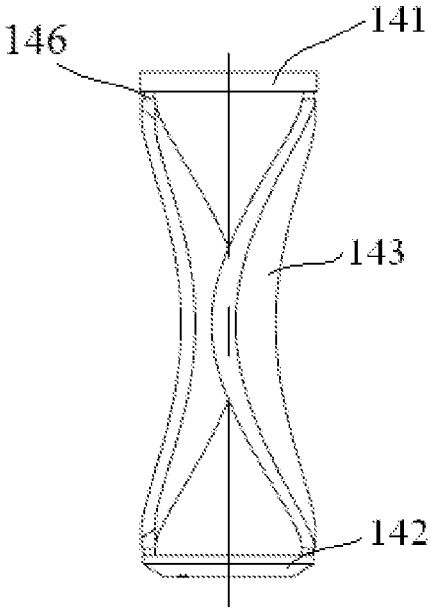
Figure 9B:
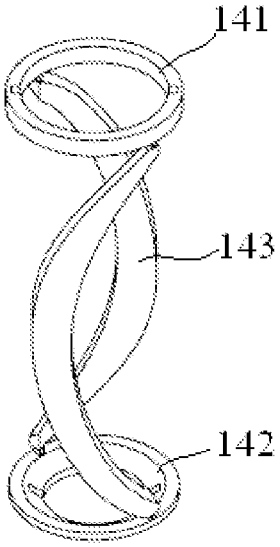
Figure 9C:
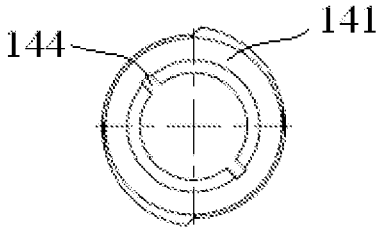
Figure 9D:
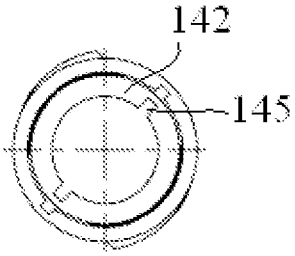

FIGS. 9*a*-9*d* show various views of the spring 140, wherein FIG. 9*a* shows a front view of the spring 140, FIG. 9*b* shows a perspective view of the spring 140, FIG. 9*c* shows a top view of the spring 140, and FIG. 9*d* shows a bottom view of the spring 140.

As shown in FIGS. 9*a*-9*c*, the spring 140 has an annular upper spring seat 141 and an annular lower spring seat 142, ends of at least one elastic strip 143 is respectively connected to the upper spring seat 141 and the lower spring seat 142. The spring 140 shown in the drawings includes two elastic spring strips 143, while one skilled in the art can know that any proper number of elastic strips 143 can be provided as desired, for example one elastic strip 143, or three or more elastic strips 143.

Preferably, a pivot 146 can be provided at the ends of the elastic strip 143 connecting to the upper spring seat 141 and/or lower spring seat 142. The pivot 146 is sheet shaped, and when the spring 140 is pressed, the sheet shaped pivot 146 can pivot and be fold onto the upper spring seat 141/lower spring seat 142.

Preferably, as shown in FIG. 9*c*, at least one guide slot 144 is formed at inner side of the upper spring seat 141 of the spring 140, which mates with a spring guide strip 132 (see FIG. 10) formed on peripheral surface of the cylinder 130, for guiding movement of the spring 140, as described in detail below.

As shown in FIG. 9*d*, an inner side of the lower spring seat 142 of the spring 140 can also be formed with a guide slot 145, which can be mate with a corresponding spring guide strip 132 on the cylinder 130.

Figure 9E:
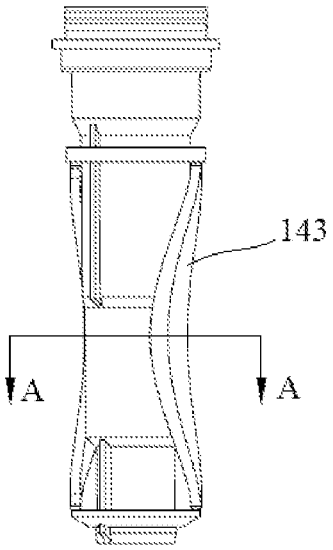
Figure 9F:
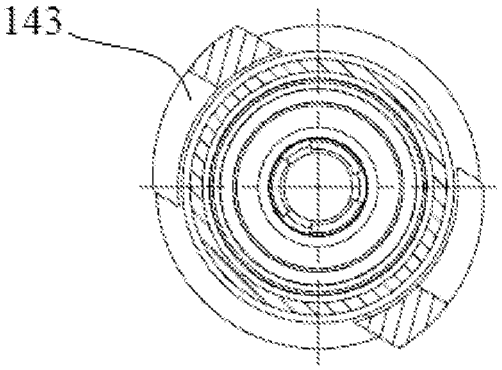

Further preferably, the elastic strip 143 is shaped so that a projection of the elastic strip in an axial direction of the lotion pump 100 is generally arc shaped. In other words, when viewed in the axial direction of the lotion pump 100, the elastic strip 143 extends around at least a portion of the periphery of the cylinder, as shown in FIGS. 9*e* and 9*f*. Thus, the structure of the lotion pump 100, especially the portion below the toothed sleeve 120 including the spring 140, can be more compact.

Of course, FIGS. 9*a*-9*f* show a preferred structure of the spring 140. Such a structure can be modified, or some part of the structure can be omitted. For example, the guide slot 144 and guide slot 145 respectively provided on the upper spring seat 141 and the lower spring seat 142 can be omitted. Further, the spring 140 can do not include the upper spring seat 141 and the lower spring seat 142, and the individual elastic strips 143 can be respectively secured on the support seating 160 and a lower portion of the cylinder 130.

Cylinder

Figure 10:
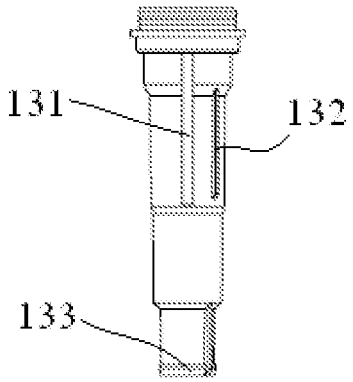
FIG. 10 is a front view of the cylinder of the lotion pump shown in FIG. 1.

FIG. 10 shows a front view of the cylinder 130. As shown in FIG. 10, an outer wall of the cylinder is formed with a trough 131, in which a guide block 161 of the supporting seat 160 is slidably received, so that the supporting seat 160 can only longitudinally move relative to the cylinder 130, and cannot rotate.

Preferably, the periphery of the cylinder 130 is also provided with a spring guide strip 132, which mates with the guide slot 144 in the upper spring seat 141 and/or the guide slot 145 in the lower spring seat 142 of the spring 140, thus functioning to guide the spring 140.

The provision of the guide slot and the guide strip can be interchanged, i.e. the upper spring seat 141/lower spring seat 142 are provided with guide strips, and the guide slot is formed on the cylinder.

Further preferably, a reversed snap part 133, which mates with the lower spring seat 142 of the spring 140, is formed at a bottom of an outer wall of the cylinder 130, for securing the lower spring seat 142, preventing upward movement of the lower spring seat 142 relative to the cylinder 130.

Toothed Sleeve

Figure 11A:
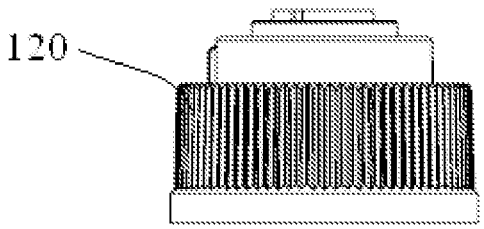
Figure 11B:
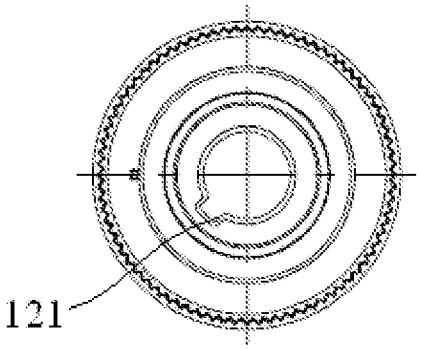

FIGS. 11*a* and 11*b* respectively show front and top views of the toothed sleeve 120. As shown in the drawings, a cutout 121 is formed on the toothed sleeve 120, especially on the top of the toothed sleeve 120. When the piston rod 150 is rotated to align the locking block 152 to the cutout 121, the locking block 152 can extend through the cutout 121, so that the piston rod 150 and the press head 110, to which the piston rod 150 connects, spring upwardly, thus bring the lotion pump 100 into the standby state.

Operation of the Lotion Pump

The operation of the lotion pump 100 of the first embodiment will be described with reference to FIGS. 4 and 5.

As shown in FIG. 4, the lotion pump 100 is in a locked state, which is useful in the situation that the lotion pump 100 is transported, sold and the like. At this time, the supporting seat 160 in the lotion pump 100 is in its highest position of its stroke, and the helical slot 162 of the supporting seat 160 mates with the helical rib 151 of the piston rod 150. When the product is sold and the lotion pump 100 is to be operated for using the product, the user rotates the press head 110 in an opening direction, thus rotate the piston rod 150 connected to the press head 110 together.

In rotating the piston rod 150, the helical rib 151 on the outer surface of the piston rod 150 interacts with the helical slot 162 on the supporting seat 160, so that the supporting seat 160 moves downwardly relative to the piston rod 150, i.e. moves in a direction towards the spring 140, until the helical rib 151 disengages from the helical slot 162. During such a process, the supporting seat 160 applies a compress force on the spring, and the compress force gradually increases. After the helical rib 151 disengages from the helical slot 162, the piston rod 150 is kept on rotating, so as to offset the helical slot 162 from the helical rib 151, so that a lower end of the helical rib 151 abuts against an upper surface of the helical slot 162. At this time, the spring 140 is brought from a free and non-standby state into a standby state.

As the piston rod 150 rotates, the locking block 152 can move into a position in which it aligns to the cutout 121 on the top of the toothed sleeve 120. At this time, the locking block 152 can extend through the cutout 121, so that the press head 110 springs upwardly into the standby state.

After the use, if it is needed to return the lotion pump 100 back to its locked state, the press head 110 is pressed downwardly to its lowest pint of stroke, then the press head 110 is rotated in a closing direction opposite to its opening direction. In such a process, the helical rib 151 of the piston rod 150 will once again mate in the helical slot 162 of the supporting seat 160, and as the piston rod 150 rotates, the helical rib 151 interacts with the helical slot 162, moving the supporting seat 160 upwardly, i.e. moving in a direction away from the spring 140, so that the compress force applied on the spring 140 reduces or goes to zero, thus the spring 140 turns back to its non-standby state. Even, the supporting seat 160 can disengage from contacting with the spring 140. Here, it can be seen that the helical rib 151 can shift the spring 140 between a non-standby state and a standby state, i.e. functioning as a shifting mechanism. In addition, the helical rib 151 can also be deemed to have separation and reunion function between the spring 140 and movable portion of the lotion pump 100 by the supporting seat 160.

Preferably, the relative position and size of the helical rib 151 and the locking block 152 of the piston rod 150 are set such that the helical rib 151 disengages from the helical slot 162 prior to alignment between the locking block 152 and the cutout 121 in the toothed sleeve 120. Thus, the helical rib 151 can be prevented from entering again into the helical slot 162 during pressing the press head 110 to pump the product.

Besides, a longitudinal length of the locking block 152 is preferably set such that during the process that the press head 110 is pressed to pump the product and the press head 110 springs back, the locking block 152 always moves within the cutout 121, thus during use, the helical rib 151 can be prevented from entering again into the helical slot 162 due to rotation of the press head 110.

It shall be specifically stated here that although in the structure illustrated above the helical rib 151 functioning as shifting mechanism is formed on the piston rod, the shifting mechanism can also be formed on any other part and other position of the movable portion of the lotion pump 100, which is also within the scope of the present invention.

Furthermore, the shifting mechanism can also be formed on the stationary portion of the lotion pump 100, for example a helical rib can be formed on an inner wall of the cylinder 130, and correspondingly, a helical slot can be formed on a periphery of the supporting seat 160. Or, in lotion pump of some structure, the piston rod formed with helical rib is a stationary portion of the lotion pump, while the cylinder is a movable portion (such a case will be explained in detail in the following embodiments). These also do not fall beyond the scope of the present invention.

Embodiment II

FIGS. 12*a*-15*b* show a lotion pump 200 of a second embodiment of the present invention. Wherein, features identical or similar to those of the lotion pump 100 of the first embodiment will not be described in detail, and only the features of the lotion pump 200 of the second embodiment not included in the first embodiment will be described. Unless contrarily expressed or structural conflicting, the features disclosed in the first embodiment may also be applied to the second embodiment.

Figure 12A:
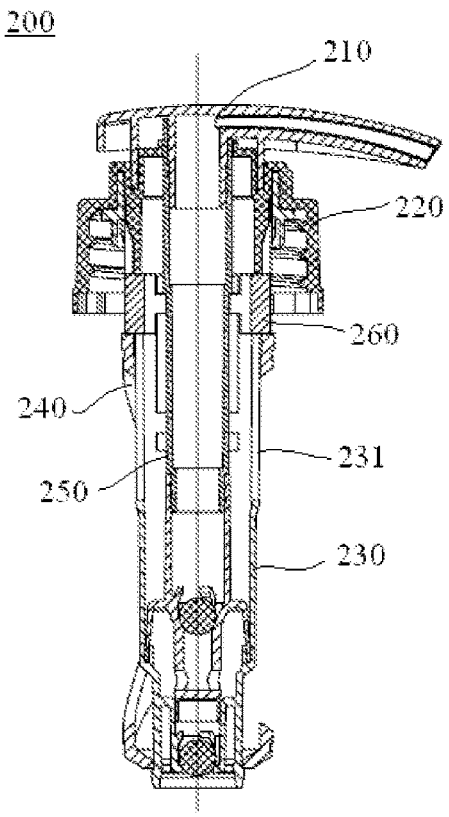
Figure 12B:
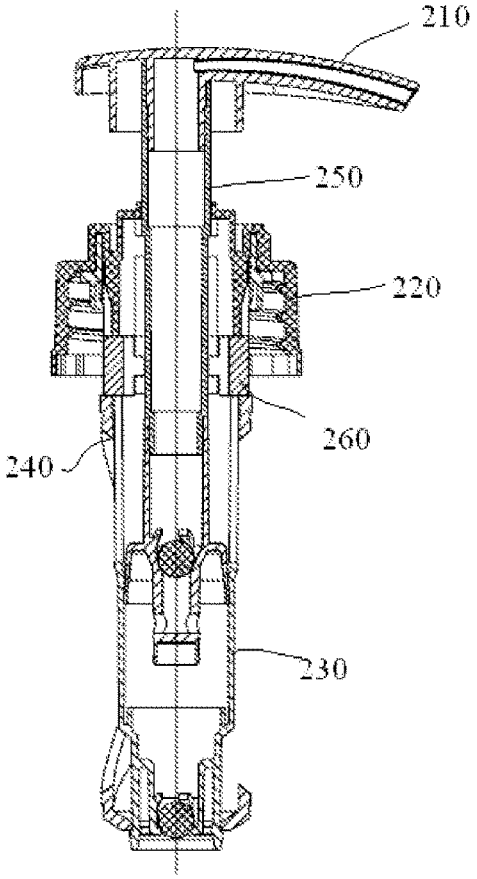

FIGS. 12*a* and 12*b* respectively show the lotion pump 200 in the locked state and the lotion pump 200 in the standby state. The lotion pump 200 includes a press head 210, a toothed sleeve 220, a cylinder 230, a spring 240 and a piston rod 250. A supporting seat 260 is provided in the cylinder 230. Identical to the first embodiment, a trough 231 is formed in the outer wall of the cylinder 230, a guide block 261 of the supporting seat 260 is slidably received in the trough 231, so that the supporting seat 260 can only longitudinally move relative to the piston rod 250.

Figure 13A:
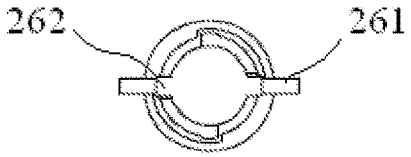
Figure 13B:
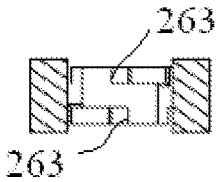
Figure 13C:
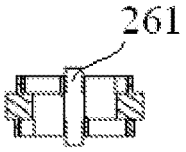
Figure 13D:
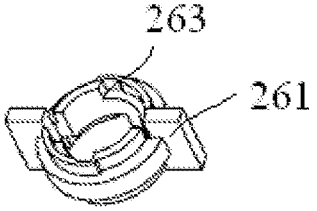

FIGS. 13*a*-13*d* show various views of the supporting seat 260 in the lotion pump 200 of the second embodiment, wherein FIG. 13*a* is a top view of the supporting seat 260, FIG. 13*b* is a sectional view of the supporting seat 260, FIG. 13*c* is another sectional view of the supporting seat 260, and FIG. 13*d* is a perspective view of the supporting seat 260.

The support ring 260 in the lotion pump 200 of the second embodiment is also generally ring shaped, having at least one guide block 261 (two guide blocks 261 provided in opposite is shown in the drawings). At least one supporting seat cutout, preferably a pair of supporting seat cutouts 262 provided in opposite shown in the figure, is formed in an inner side of the supporting seat 260. Preferably, at least one supporting seat stop 263 is further formed at inner side of the supporting seat 260, preferably the upper and lower portions of inner side of the supporting seat 260 are respectively formed with the supporting seat stop 263.

Figure 14A:
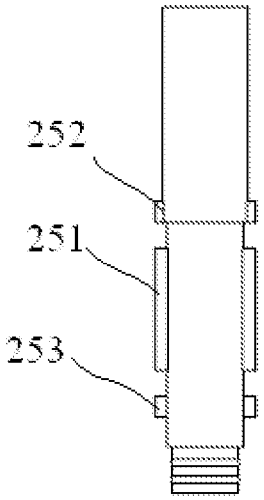
Figure 14B:
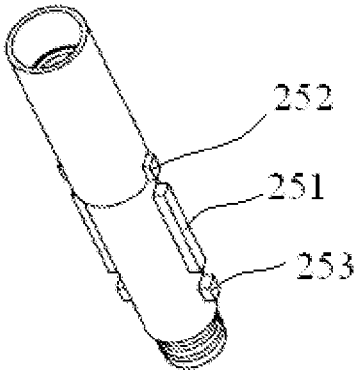

FIGS. 14*a* and 14*b* respectively show front and perspective views of the piston rod 250. Corresponding to the supporting seat cutout 262 in the supporting seat 260, a guide strip 251 is formed on periphery of the piston rod 250. In addition, the piston rod 250 is preferably further formed with an upper locking block 252 and a lower locking block 253 respectively positioned on upper and lower sides of the guide strip 251. The upper locking block 252 and the lower locking block 253 mate with the supporting seat stop 263, so that the piston 250 can only rotate in a preset direction.

Figure 15A:
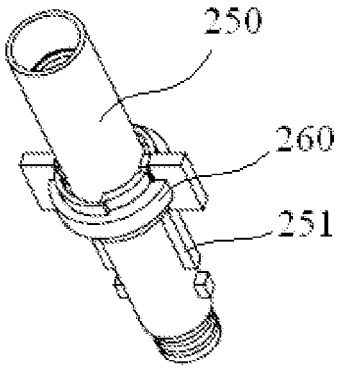
FIGS. 15*a* and 15*b* show perspective views showing interaction between the supporting seat and the piston rod, wherein in FIG. 15*a*, the supporting seat is in a first position relative to the piston rod, and in FIG. 15*b*, the supporting seat is in a second position.
Figure 15B:
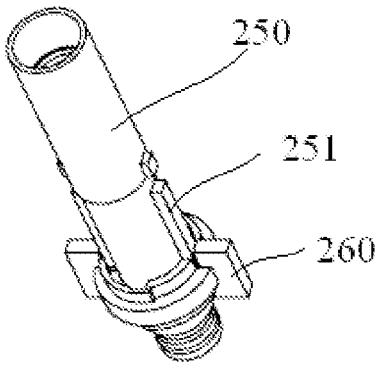

The piston rod 250 and the supporting seat 260 mate with each other as shown in FIGS. 15*a* and 15*b*.

The operation of the lotion pump 200 of the second embodiment will be described below with reference to FIGS. 12*a*, 12*b*, 15*a* and 15*b*.

As shown in FIGS. 12*a* and 15*a*, when the lotion pump 200 is in the locked state, the supporting seat 260 is positioned above the guide strip 251 of the piston rod 250, and the supporting seat cutout 262 offsets from the guide strip 251, so that the position of the supporting seat 260 fixes with respect to the piston rod 250.

When the lotion pump 200 is to be used, the press head 210 is rotated in an opening direction, so that the supporting seat cutout 262 aligns to the guide strip 251, at this time, the press head 210 can be manually pulled upward to its highest point of stroke, the supporting seat 260 moves relative to the piston rod 250 below the guide strip 251. Then, rotation of the press head 210 continues, so that the supporting seat cutout 262 once again offsets from the guide strip 251, so that the guide strip 251 limits the supporting seat 260 at a position below it. At this time, the spring 240 is loaded, so that pumping is possible by pressing the press head 210.

After use, if it is needed to return the lotion pump 200 to the locked state, the press head 210 can be rotated in an oppose direction, so that the supporting seat cutout 262 once again aligns to the guide strip 251, then the press head can be manually pressed to its lowest point of stroke, the rotation of the press head 210 continuous, so that the supporting seat cutout 262 offsets from the guide strip 251, and the guide strip 251 holds the supporting seat 260 at a position thereabove.

Preferably, in the case that the piston rod 250 is provided with the upper locking block 252 and the lower locking block 253, and the supporting seat 260 is provided with the supporting seat stop 263, the upper and lower locking blocks 252, 253 interact with the supporting seat stop 263, so that the user can rotate the press head 210 only in a preset direction.

Embodiment III

Figure 16A:
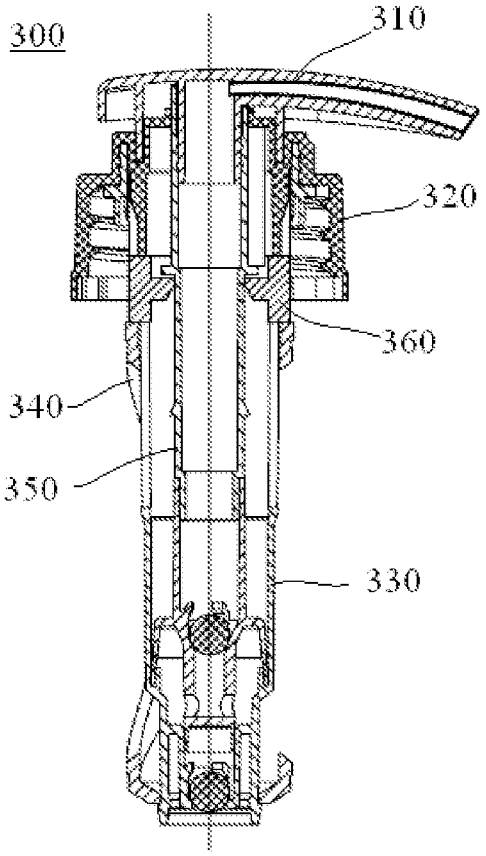
Figure 16B:
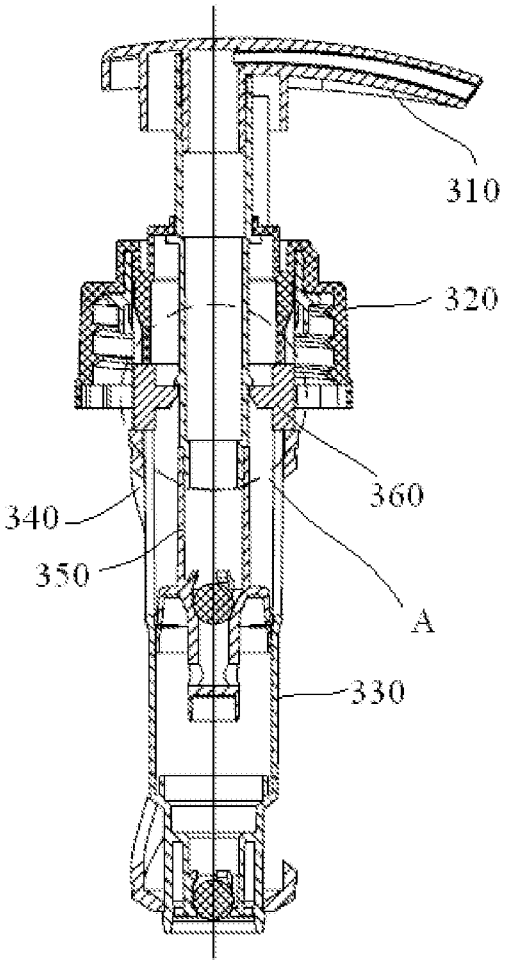
Figure 17:
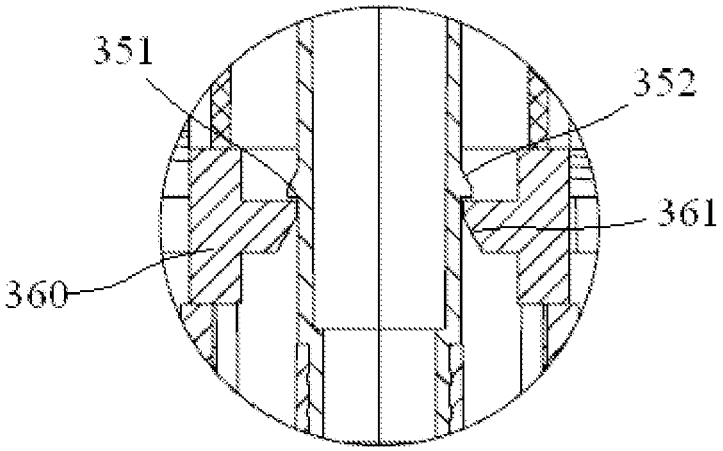
FIG. 17 is a partially enlarged view of part A in FIG. 16*b*.

FIGS. 16*a*-17 show a lotion pump 300 of a third embodiment of the present invention. Wherein, features identical or similar to those of the lotion pumps of the first and second embodiments will not be described in detail, and only the features of the lotion pump 300 of the third embodiment not included in the first and second embodiments will be described. Unless contrarily expressed or structural conflicting, the features disclosed in the first and second embodiments also may be applied to the third embodiment.

The lotion pump 300 includes a press head 310, a toothed sleeve 320, a cylinder 330, a spring 340 and a piston rod 350, and the lotion pump 300 also includes a supporting seat 360. In the lotion pump 300 of the third embodiment, a reversed snap ring 351 is formed on the piston rod 350, a first chamfer 352 facing upwardly is formed on the reversed snap ring 351, and a second chamfer 361 facing downwardly is formed correspondingly on the supporting seat 360.

In the locked position shown in FIG. 16*a*, the press head 310 is at the lowest point of its stroke, the supporting seat 360 is positioned above the reversed snap ring 351. After the press head 310 is rotated to an opening position, the press head 310 is pulled to the highest point of its stroke, during which the reversed snap ring 351 moves upwardly through the supporting seat 360 and above the supporting seat 360. At this time, the structure of the reversed snap ring 351 prevents the supporting seat 360 returning back again to the position above the reversed snap ring 351. Thus, the lotion pump 300 is held in the standby state shown in FIG. 16*b*.

Embodiment IV

Figure 18A:
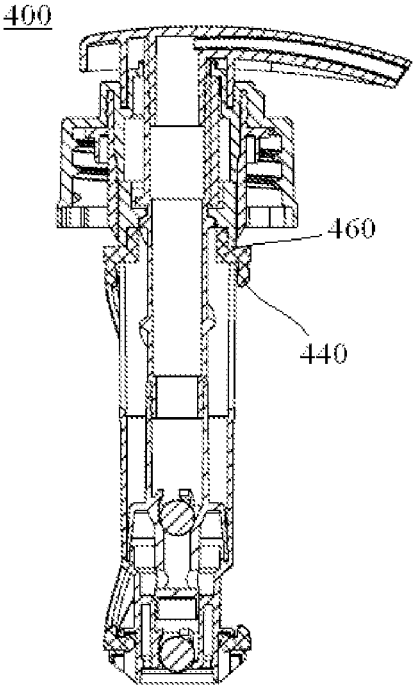
FIG. 18*a* is a sectional view of a lotion pump of a fourth embodiment of the present invention.
Figure 18B:
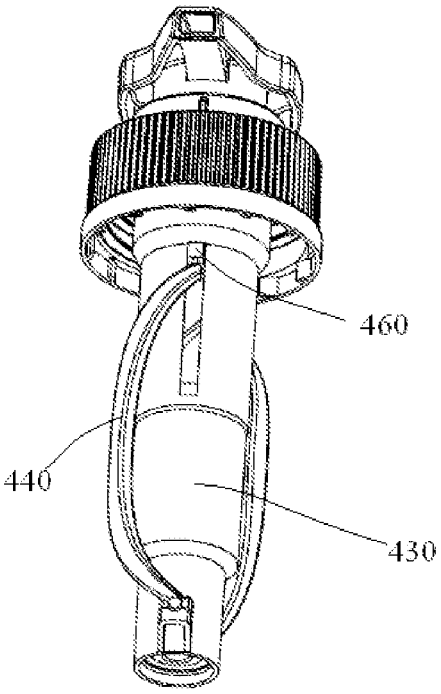
FIG. 18*b* shows a perspective view of the lotion pump shown in FIG. 18*a*.

FIGS. 18*a* and 18*b* show a lotion pump 400 of a fourth embodiment of the present invention. Wherein, features identical or similar to those of the lotion pumps of the first to third embodiments will not be described in detail, and only the features of the lotion pump 400 of the fourth embodiment not included in the first to third embodiments will be described. Unless contrarily expressed or structural conflicting, the features disclosed in the first to third embodiments may also be applied to the fourth embodiment.

The lotion pump 400 of the fourth embodiment is substantially identical to the lotion pump 100 of the first embodiment, and it is distinguished only in that the upper spring seat 141 and the lower spring seat 142 of the spring 140 is omitted. In other words, in the lotion pump 400, the upper end of the elastic strip of the spring 440 is directly connected to the supporting seat 460, and the lower end of the elastic strip is directly connected to the lower part of the cylinder 430.

Embodiment V

FIGS. 19*a*-22 show a lotion pump 500 of a fifth embodiment of the present invention. Wherein, features identical or similar to those of the lotion pumps of the first to fourth embodiments will not be described in detail, and only the features of the lotion pump 500 of the fifth embodiment not included in the first to fourth embodiments will be described. Unless contrarily expressed or structural conflicting, the features disclosed in the first to fourth embodiments may also be applied to the fifth embodiment.

Figure 19A:
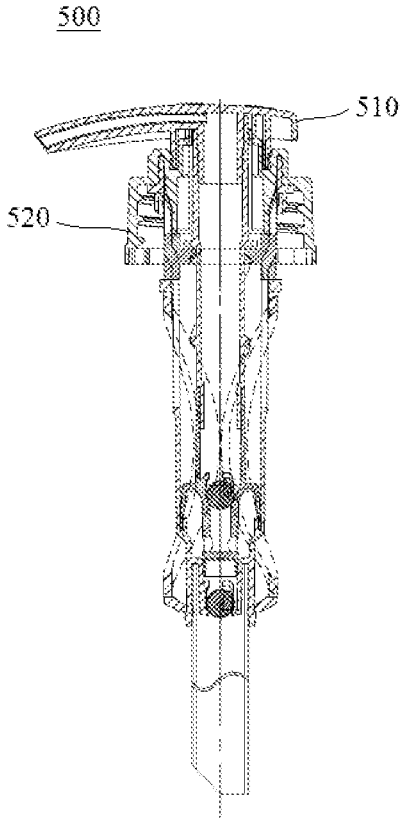
Figure 19B:
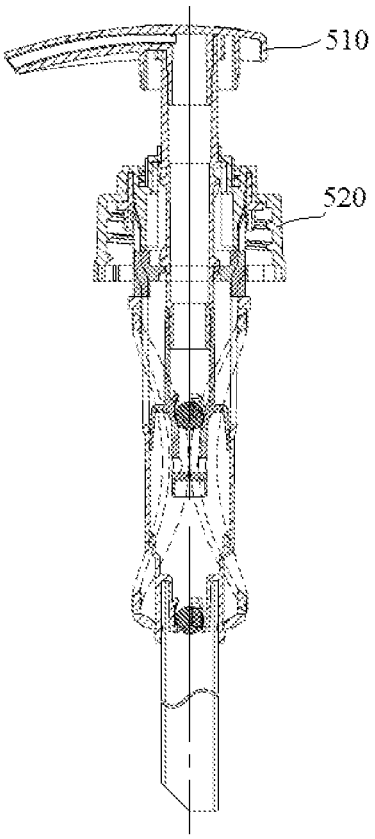
Figure 20:
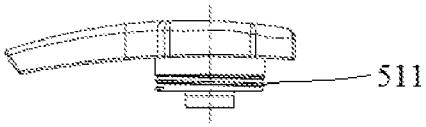
FIG. 20 shows a side view of a press head of the lotion pump of FIGS. 19*a* and 19*b*.

FIG. 19 shows a sectional view of a lotion pump 500 in a lower locked state, and FIG. 19*b* shows a sectional view of the lotion pump 500 in a standby state. It can be seen from FIGS. 19*a* and 19*b* that, in the fifth embodiment, the press head 510 of the lotion pump 500 is provided at its lower part with an outer thread, and is secured in a locked position via a thread connection between the press head 510 and the toothed sleeve 520. FIG. 20 shows the outer thread 511 on the press head 510 more clearly. Correspondingly, an inner thread mating with the outer thread 511 is formed in an opening of the toothed sleeve.

Figure 21:
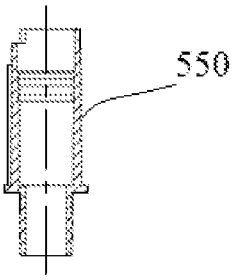
FIG. 21 shows a sectional view of a piston rod of the lotion pump of FIGS. 19*a* and 19*b*.
Figure 22:
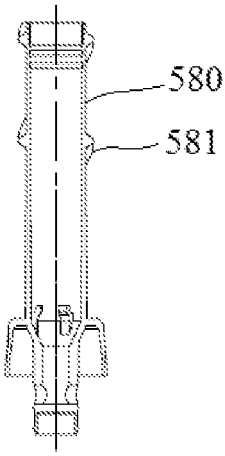
FIG. 22 shows a sectional view of a piston of the lotion pump of FIGS. 19*a* and 19*b*.
Figure 23:
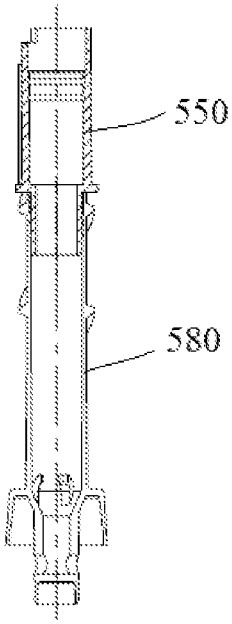
FIG. 23 shows a sectional view in which the piston rod of FIG. 21 and the piston of FIG. 22 are assembled together.
Figure 24:
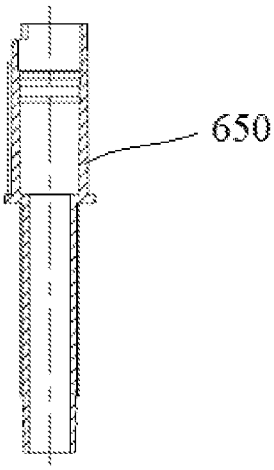
FIG. 24 shows a sectional view of a piston rod of the lotion pump in a varied structure.
Figure 25A:
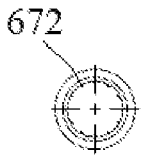
FIG. 25*a* shows a top view of a casing in the lotion pump in the varied structure.
Figure 25B:
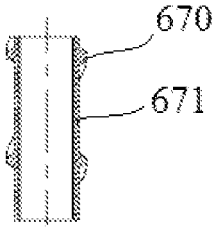
FIG. 25*b* shows a sectional view of the casing of FIG. 25*a*.
Figure 26:
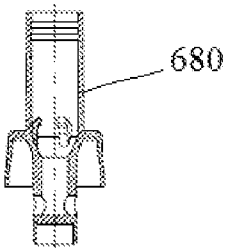
FIG. 26 shows a sectional view of a piston of the lotion pump in the varied structure.

Further, as shown in FIGS. 21-23, the piston rod 550 of the lotion pump 500 is formed separately from the piston 580, and they are connected together. A helical rib functioning as a shifting part can be formed on the outer surface of any one of the piston rod 550 and the piston 580, or is partially formed on the outer surface of the piston rod 550 and partially formed on the outer surface of the piston 580. In the structure shown in the drawings, a helical rib 581 is formed on the outer surface of the piston 580.

Of course, the structures of reversed snap ring and chamfer of the third embodiment may also be applied to the case that piston rod and piston are separately formed as shown in FIGS. 21-23.

Figure 27:
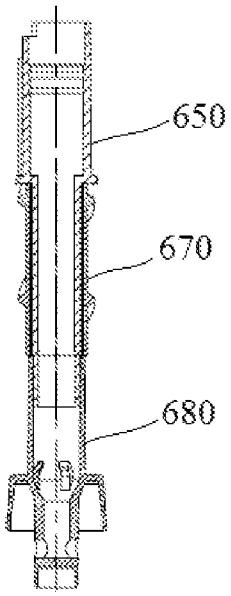
FIG. 27 shows a sectional view in which the piston rod, the casing and the piston of FIGS. 24-26 are assembled together.

FIGS. 24-27 show variations of a part of the structure of the fifth embodiment. Wherein, the piston rod 650 and the piston 680 are also separately formed, and then connected together. Different from the structure shown in FIGS. 21-23, in the structure shown in FIGS. 24-27, a casing 670 is additionally provided, the outer surface of the casing 670 is formed with a helical rib 671 or other types of shifting parts. And, the casing 670 is sleeved on the outer surfaces of the piston rod 650 and the piston 680 connected together, as shown in FIG. 27. Preferably, such structure as rib 672 is also formed on an inner surface of the casing 670, which facilitates in close engagement to the outer surface of the piston rod 650 and/or the piston 680.

Embodiment VI

Figure 28A:
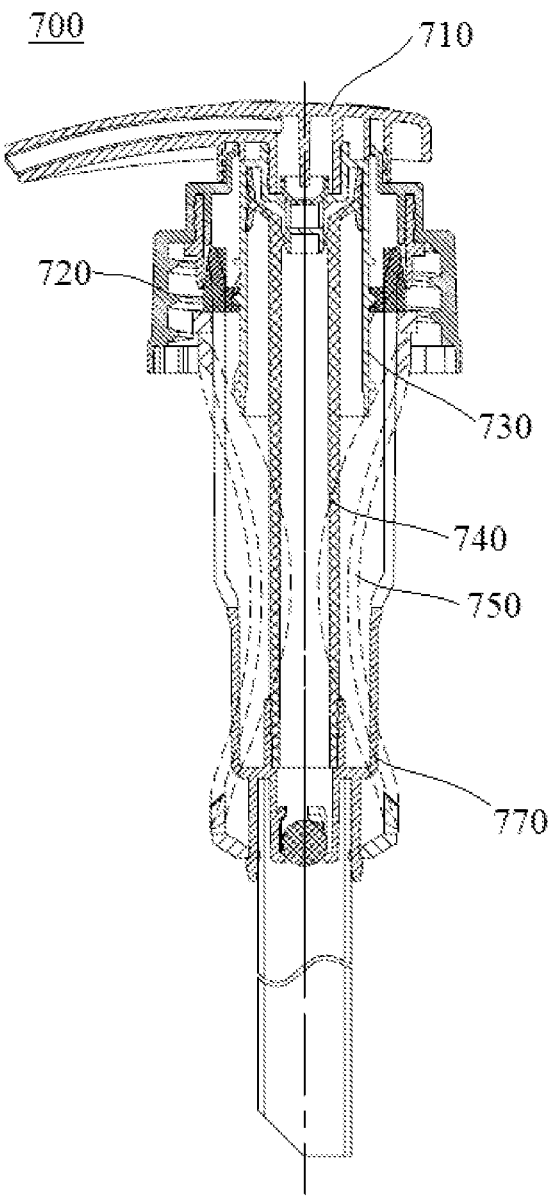
Figure 28B:
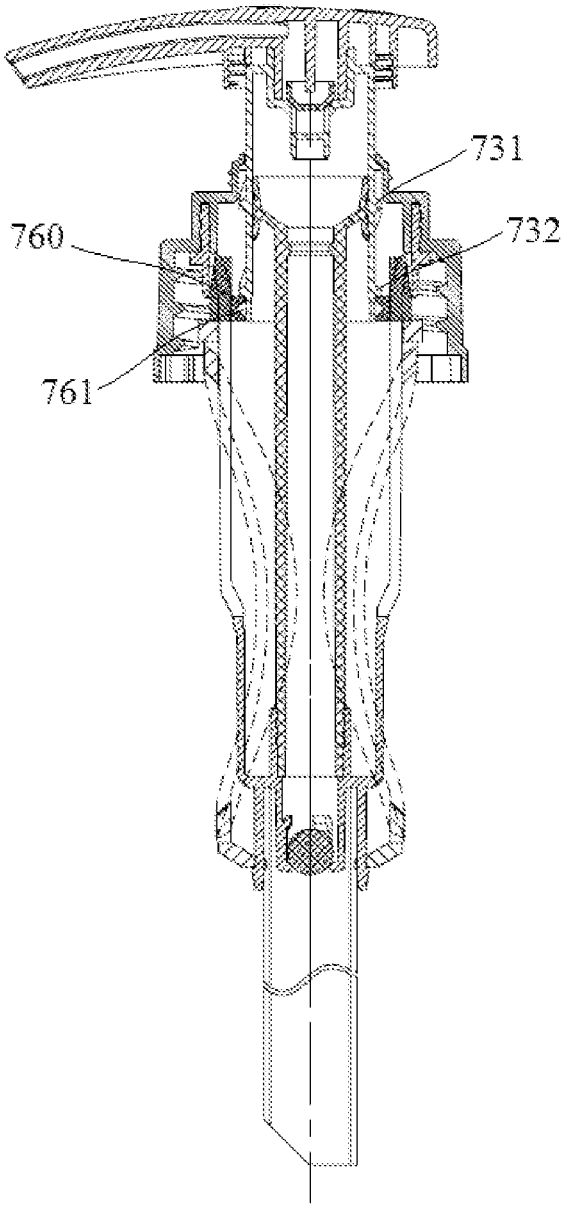
Figure 29:
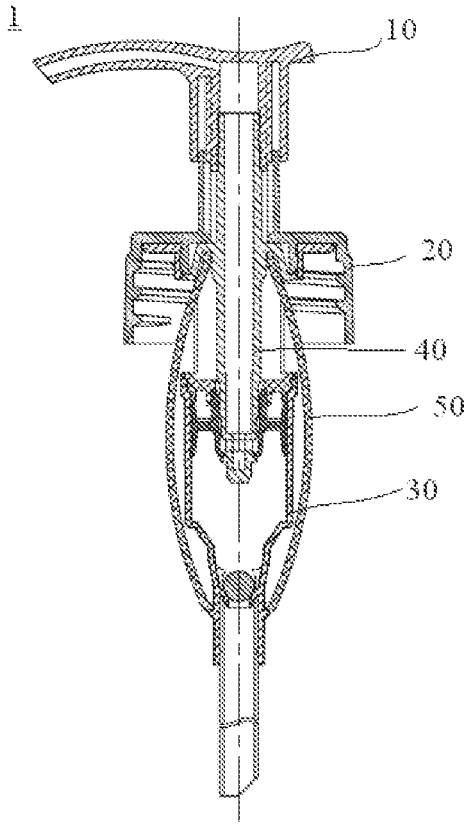
FIG. 29 Prior Art
FIG. 29 shows a sectional view of a lotion pump in the prior art.

FIGS. 28*a* and 28*b* show a lotion pump 700 of a sixth embodiment of the present invention. Wherein, features identical or similar to those of the lotion pumps of the first to fifth embodiments and variations thereof will not be described in detail, and only the features unique in the lotion pump 700 of the sixth embodiment will be described. And, unless contrarily expressed or structural conflicting, the features disclosed in the first to fifth embodiments may also be applied to the fifth embodiment.

FIG. 28*a* shows a sectional view of a lotion pump 700 in a lower locked state, and FIG. 28*b* shows a sectional view of the lotion pump 700 in a standby state. It can be seen in the drawings that the lotion pump 700 includes a press head 710, and a cylinder 730 is connected to a lower part of the press head 710. So, in the sixth embodiment, movement of the press head 710 (such as rotation or moving up and down) brings the cylinder 730 to move together, so that the press head 710 and the cylinder 730 configures at least a part of the movable portion of the lotion pump.

In addition, in the lotion pump 700 of the sixth embodiment, a spring bracket 770 is connected on the toothed sleeve 720, one end of the spring 750 (specifically the lower end shown in FIGS. 28*a* and 28*b*) is supported on the spring bracket 770, and the other end of the spring 750 (upper end in the drawings) is supported on the spring supporting seat 760.

The spring bracket 770 is further fixed with the piston rod 740, and the piston on one end of the piston rod 740 extends into the cylinder 730.

As shown in FIGS. 28*a* and 28*b*, a first protrusion 731 and a second protrusion 732 are formed on an outer wall of the cylinder 730, and a slot 761 is formed on an inner surface of the spring supporting seat 760. As the press head 710 and the cylinder 730 move up and down, the slot 761 can mate respectively with one of the first protrusion 731 and the second protrusion 732. For example, when the slot 761 mates with the protrusion 731 positioned above (the state shown in FIG. 28*a*), the spring 750 is in non-loaded state, and when the slot 761 mates with the second protrusion 732 positioned below, or even is below the second protrusion 732, the spring 750 is in its loaded state.

So, in the sixth embodiment, it is the first protrusion 731 and second protrusion 732 formed on outer surface of the cylinder 730 that function as the shifting mechanism. Of course, the embodied structures of helical rib, guide strip and the like mentioned in the preceding embodiments may also be applied to the sixth embodiment.

The invention claimed is:

1. A lotion pump, which is mounted on a container for dispensing product in the container, the lotion pump includes a movable portion and a stationary portion, when used, the movable portion is movable relative to the container, and the stationary portion remains station relative to the container, wherein the lotion pump further comprises: a spring assembly, one end of which contacts or connects to the movable portion and the other end of which is fixed to the stationary portion; and a shifting mechanism having at least a first mating part and a second mating part, the first mating part comprising at least one from the group consisting of a helical rib, a helical slot, a guide strip, a cutout, and a snap ring and the second mating part comprising at least one from the group consisting of the helical rib, the helical slot, the guide strip, the cutout, and the snap ring, the first mating part and the second mating part being provided on the movable portion or the stationary portion, and the shifting mechanism is provided to mate with the spring assembly, so that when the movable portion of at least one from the group consisting of rotates in a first direction and moves upwardly, the one end of the spring assembly moves relative to the movable portion to a first position, so that the spring assembly is loaded to be brought into a standby state, and when the movable portion of at least one from the group consisting of rotates in a second direction opposite to the first direction and moves downwardly, the one end of the spring assembly moves relative to the movable portion to a second position, thus a compress force is applied on the spring assembly is reduced or goes to zero, so that the spring assembly is brought into a non-standby state.

2. The lotion pump of claim 1, wherein the shifting mechanism is provided on the movable portion.

3. The lotion pump of claim 2, wherein the second mating part of the shifting mechanism is formed on the spring assembly, when the movable portion moves relative to the container, the first mating part cooperates with the second mating part, so that the one end of the spring assembly is moved between the first position and the second position.

4. The lotion pump of claim 3, wherein the spring assembly includes a spring and a spring supporting seat, the spring supporting seat is positioned at the one end of the spring, and the second mating part is formed on the spring supporting seat.

5. The lotion pump of claim 4, wherein one of the first mating part and the second mating part is the helical rib, the other one of the first mating part and the second mating part is the helical slot, the helical rib can mate into the helical slot, so that when the movable portion rotates, the helical slot and the helical rib act with each other, so that the one end of the spring assembly moves between the first position and the second position.

6. The lotion pump of claim 5, wherein the stationary portion includes a toothed sleeve and a cylinder, the movable portion includes a press head and a piston rod, wherein the cylinder is connected to the toothed sleeve, a piston is provided on the piston rod, and at least a portion provided with the piston of the piston rod extends into inside of the cylinder, wherein one of the one end of the spring assembly and an outer wall of the cylinder includes a guide block, and the other of the one end of the spring assembly and the outer wall of the cylinder is formed with a trough, the guide block is at least partially received in the trough.

7. The lotion pump of claim 5, wherein the movable portion includes a press head, a piston rod and a piston, wherein the piston rod is connected at a lower part of the press head, and the piston is provided on the piston rod, wherein the first mating part is formed on a peripheral surface of at least one from the group consisting of the piston rod and of the piston.

8. The lotion pump of claim 5, wherein the movable portion includes a press head, a piston rod, a piston and a casing, wherein the piston rod is connected at a lower part of the press head, and the piston is provided on the piston rod, wherein the casing is sleeved outside at least one from the group consisting of the piston rod and the piston, and the first mating part is formed on an outer surface of the casing.

9. The lotion pump of claim 2, wherein the second mating part is formed on the spring assembly and wherein the first mating part is a reversed snap ring, by pulling the movable portion upwardly, the second mating part can move through the reversed snap ring so as to move from a first position to a second position, and is held in the second position by the reversed snap ring.

10. The lotion pump of claim 2, wherein the spring assembly includes at least one elastic strip.

11. The lotion pump of claim 10, wherein the spring assembly further includes at least one from the group consisting of: an annular upper spring seat, on which an upper end of the elastic strip is connected; and an annular lower spring seat, on which a lower end of the elastic strip is connected.

12. The lotion pump of claim 11, wherein the elastic strip is connected to at least one from the group consisting of the upper spring seat and the lower spring seat by a pivot, wherein when the spring assembly is compressed, the pivot pivots and folds.

13. The lotion pump of claim 11, wherein at least one from the group consisting of a first guide slot is formed on one of an inner side of the upper spring seat and the stationary portion, a first guide strip is formed on the other of the inner side of the upper spring seat and the stationary portion, and the first guide slot mates with the first guide strip; and a second guide slot is formed on one of the inner side of the lower spring seat and the stationary portion, a second guide strip is formed on the other of the inner side of the lower spring seat and the stationary portion, and the second guide slot mates with the second guide strip.

14. The lotion pump of claim 11, wherein a reversed snap part is provided at a lower part of the stationary portion, the reversed snap part secures the lower spring seat of the spring.

15. The lotion pump of claim 10, wherein the movable portion includes a press head, a piston rod and a piston, wherein the piston rod is connected at a lower part of the press head, and the piston is provided on the piston rod, the stationary portion includes a toothed sleeve and a cylinder, wherein the cylinder is connected to the toothed sleeve, and at least the portion of the piston rod provided with the piston extends into inside of the cylinder, as seen in an axial direction of the lotion pump, the elastic strip extends around at least a portion of a peripheral surface of the cylinder of the lotion pump.

16. The lotion pump of claim 3, wherein the first mating part is the guide strip, and the second mating part is the cutout, by means of rotation of the movable portion, the guide strip aligns to the cutout, thus in turn allowing the one end of the spring assembly to move between the first position and the second position.

17. The lotion pump of claim 16, wherein at least one from the group consisting of an upper locking block is provided above the guide strip and a lower locking block is provided below the guide strip; and a stop is formed at least one from the group consisting of above and below the second mating part, the stop mates with at least one from the group consisting of the upper locking block and the lower locking, so that the movable portion can only rotate in a preset direction.

18. The lotion pump of claim 1, wherein the movable portion includes a press head, a piston rod and a piston, wherein the piston rod is connected at a lower part of the press head, and the piston is provided on the piston rod, the stationary portion includes a toothed sleeve and a cylinder, wherein the cylinder is connected to the toothed sleeve, and at least the portion of the piston rod provided with the piston extends into inside of the cylinder.

19. The lotion pump of claim 18, wherein a locking block is formed at one of a peripheral surface of the piston rod and a top of the toothed sleeve, and a cutout is formed at the other of the peripheral surface of the piston rod and the top of the toothed sleeve, thus by rotating the piston rod, the locking block aligns with the cutout, thus allowing the press head and the piston rod to move upwardly.

20. The lotion pump of claim 19, wherein the second mating part of the shifting mechanism is formed on the spring assembly, one of the first mating part and the second mating part is the helical rib, and the other one of the first mating part and the second mating part is the helical slot, as the movable portion rotates, the helical rib can disengage from the helical slot, and a size and a relative position of the helical rib and the helical slot are set such that as the movable portion rotates, the helical rib disengages from the helical slot prior to alignment of the locking block to the cutout.

* * * * *